United States Patent [19]

Mohr

[11] Patent Number: 4,554,216

[45] Date of Patent: Nov. 19, 1985

[54] PROCESS FOR MANUFACTURING SUPPORT MATERIALS FOR OFFSET PRINTING PLATES

[75] Inventor: Dieter Mohr, Roemerberg, Fed. Rep. of Germany

[73] Assignee: Hoechst Aktiengesellschaft, Frankfurt am Main, Fed. Rep. of Germany

[21] Appl. No.: 466,087

[22] Filed: Feb. 14, 1983

[30] Foreign Application Priority Data

Feb. 23, 1982 [DE] Fed. Rep. of Germany ..... 3206469

[51] Int. Cl.[4] ..... C25D 11/12; B41N 1/08

[52] U.S. Cl. ..... 428/469; 204/27; 204/33; 204/38.3; 204/42; 204/58; 430/278

[58] Field of Search ..... 204/33, 38 A, 42, 58, 204/27; 428/469; 430/278

[56] References Cited

U.S. PATENT DOCUMENTS

| | | | |
|---|---|---|---|
| 3,181,461 | 4/1965 | Fromson | 101/149.2 |
| 3,321,385 | 5/1967 | Fazzari | 204/42 |
| 3,440,050 | 4/1969 | Chu et al. | 90/75 |
| 3,511,661 | 5/1970 | Rauner et al. | 96/86 |
| 3,666,638 | 5/1972 | Harris et al. | 204/35 N |
| 3,808,000 | 4/1974 | Magnotta et al. | 96/35 |
| 3,836,437 | 9/1974 | Osada et al. | 204/17 |
| 3,902,976 | 9/1975 | Walls | 204/38 |
| 3,940,321 | 2/1976 | Adams | 204/58 |
| 3,945,899 | 3/1976 | Nikaido et al. | 204/181 |
| 3,960,676 | 6/1976 | Miyosawa et al. | 204/38 |
| 4,049,504 | 9/1977 | Chu et al. | 204/38 |
| 4,105,511 | 8/1978 | Nikaido et al. | 204/38 A |
| 4,153,461 | 4/1979 | Berghauser et al. | 96/75 |
| 4,175,964 | 11/1979 | Uchida et al. | 430/253 |
| 4,229,266 | 10/1980 | Usbeck | 204/33 |
| 4,396,470 | 8/1983 | Atkinson | 204/38 A |

FOREIGN PATENT DOCUMENTS

| | | |
|---|---|---|
| 0008212 | 3/1979 | European Pat. Off. . |
| 0007233 | 7/1979 | European Pat. Off. . |
| 0007234 | 1/1980 | European Pat. Off. . |
| 2548177 | 5/1977 | Fed. Rep. of Germany . |
| 2729391 | 12/1977 | Fed. Rep. of Germany . |
| 1244723 | 9/1971 | United Kingdom . |
| 1410768 | 10/1975 | United Kingdom . |
| 1412929 | 11/1975 | United Kingdom . |
| 1441476 | 6/1976 | United Kingdom . |
| 1495861 | 12/1977 | United Kingdom . |
| 1517746 | 7/1978 | United Kingdom . |
| 1523030 | 8/1978 | United Kingdom . |
| 1587260 | 4/1981 | United Kingdom . |

OTHER PUBLICATIONS

Chemical Abstract (84: 97133x).

Metal Finishing–Sep./Oct. 1979–vol. 21, No. 5.

*Primary Examiner*—Andrew H. Metz

*Assistant Examiner*—W. T. Leader

*Attorney, Agent, or Firm*—Schwartz, Jeffery, Schwaab, Mack, Blumenthal & Evans

[57] ABSTRACT

The process for manufacturing support materials for offset-printing plates is carried out in two stages. These materials are in the form of plates, foils, or strips, composed of aluminum, or an alloy thereof, which have been roughened by chemical, mechanical and/or electrochemical treatment. These two stages comprise an anodic oxidation in (a) an aqueous electrolyte based on sulfuric acid, and in (b) an aqueous electrolyte which is different from that in stage (a). An electrolyte with a content of dissolved oxoanions of boron, vanadium, molybdenum, tungsten, and/or carbon is employed in stage (b), and the treatment is carried out at a voltage between about 10 and 100 V, at a temperature of from about 10° to 60° C., and for a duration of from about 1 to 60 seconds. The electrolyte is an acid or, in particular, a salt with the above-mentioned anions. Following stage (b), it is also possible to carry out an additional treatment to impart hydrophilic properties to the support material.

5 Claims, No Drawings

PROCESS FOR MANUFACTURING SUPPORT MATERIALS FOR OFFSET PRINTING PLATES

BACKGROUND OF THE INVENTION

The present invention relates to a two-stage anodic oxidation process for aluminum, which is employed as a support material for offset-printing plates.

Support materials for offset-printing plates are provided, on one or both sides, with a photosensitive coating (copying coating), either directly by the consumer, or by the manufacturers of precoated printing plates. This coating permits the production of a printing image by a photomechanical route. Following the production of the printing image, the coating-support carries the printable image-areas, and simultaneously there is formed, in the areas where there is no image (non-image areas), the hydrophilic image-background for the lithographic printing operation.

For the above reasons, the following requirements are demanded of a coating-support for photosensitive material for the manufacture of lithographic plates:

- Those portions of the photosensitive coating which have become comparatively more soluble following exposure must be capable of being easily removed from the support, by a developing operation, in order to produce the hydrophilic non-image areas without leaving a residue.
- The support, which has been laid bare in the non-image areas, must possess a high affinity for water, i.e., it must be strongly hydrophilic, in order to accept water, rapidly and permanently, during the lithographic printing operation, and to exert an adequate repelling effect with respect to the greasy printing ink.
- The photosensitive coating must exhibit an adequate degree of adhesion prior to exposure, and those portions of the coating which print must exhibit adequate adhesion following exposure.
- The support material should possess good mechanical stability, for example, with respect to abrasion, and good chemical resistance, especially with respect to alkaline media.

Aluminum is used, particularly frequently, as the base material for coating-supports of this type, the surface of this aluminum being roughened, according to known methods, by dry-brushing, wet brushing, sandblasting, or by chemical and/or electrochemical treatments. In order to increase the resistance to abrasion, substrates which have been roughened, especially by electrochemical treatments, are further subjected to an anodizing step, with the object of building up a thin oxide layer. These anodic oxidation processes are conventionally carried out in electrolytes such as $H_2SO_4$, $H_3PO_4$, $H_2C_2O_4$, $H_3BO_3$, sulfamic acid, sulfosuccinic acid, sulfosalicylic acid or mixtures thereof. The oxide layers built up in these electrolytes or electrolyte mixtures differ from one another in structure, layer thickness and resistance to chemicals. In the commercial production of offset-printing plates, aqueous solutions of $H_2SO_4$ or $H_3PO_4$ are, in particular, employed.

By way of example, readers are referred to the following standard methods for the use of aqueous electrolytes, containing $H_2SO_4$, for the anodic oxidation of aluminum (see, in this regard, e.g. M. Schenk, Werkstoff Aluminiun und seine anodische Oxydation [The Material Aluminum and its Anodic Oxidation], Francke Verlag, Bern, 1948, page 760; Praktische Galvanotechnik [Practical Electroplating], Eugen G. Leuze Verlag, Saulgau, 1970, pages 395 et seq., and pages 518/519; W. Huebner and C. T. Speiser, Die Praxis der anodischen Oxidation des Aluminiums [Practical Technology of the Anodic Oxidation of Aluminum], Aluminium Verlag, Duesseldorf, 1977, 3rd Edition, pages 137 et seq.):

- The direct current sulfuric acid process, in which anodic oxidation is carried out in an aqueous electrolyte which conventionally contains approximately 230 g of $H_2SO_4$ per 1 liter of solution, for 10 to 60 minutes at 10° to 22° C., and at a current density of 0.5 to 2.5 A/dm$^2$. In this process, the sulfuric acid concentration in the aqueous electrolyte solution can also be reduced to 8 to 10% by weight of $H_2SO_4$ (about 100 g of $H_2SO_4$ per liter), or it can also be increased to 30% by weight (365 g of $H_2SO_4$ per liter), or more.
- The "hard-anodizing process" is carried out using an aqueous electrolyte, containing $H_2SO_4$ in a concentration of 166 g of $H_2SO_4$ per liter (or about 230 g of $H_2SO_4$ per liter), at an operating temperature of 0° to 5° C., and at a current density of 2 to 3 A/dm$^2$, for 30 to 200 minutes, at a voltage which rises from approximately 25 to 30 V at the beginning of the treatment, to approximately 40 to 100 V toward the end of the treatment.

Aluminum oxide layers, produced by these methods, are amorphous and, in the case of offset-printing plates, conventionally have a layer-weight of approximately 1 to 8 g/m$^2$ corresponding to a layer thickness of approximately 0.3 to 2.5 $\mu$m. The oxide layers are distinguished by a fine channel-like structure; they possess good mechanical stability as a result of which they protect, in particular, the structure of electrochemically roughened aluminum against abrasion. The oxide layers produced in $H_2SO_4$ electrolytes possess a comparatively low resistance to alkaline solutions, which are used to an increasing extent, for example, in the processing of presensitized offset-printing plates, and which are used preferentially in up-to-date developing solutions for exposed photosensitive coatings working either negatively or, in particular, positively. This comparatively low resistance to alkaline solutions is a disadvantage when a carrier material which has been anodically oxidized in this way is used for offset-printing plates.

Also known is the anodic oxidation of aluminum in aqueous electrolytes containing oxygen acids of phosphorus, or containing phosphates.

A process for manufacturing a lithographic printing plate is described in U.S. Pat. No. 3,511,661, in which process the aluminum support is anodically oxidized in a 42, 50, 68 or 85% strength aqueous $H_3PO_4$ solution, at a temperature of at least 17° C., until the layer of aluminum oxide has a thickness of at least 50 nm.

A process is known from U.S. Pat. No. 3,594,289, in which a printing-plate support material, composed of aluminum, is anodically oxidized in a 50% strength aqueous $H_3PO_4$ solution, at a current density of 0.5 to 2.0 A/dm$^2$ and a temperature of 15° to 40° C.

The process for the anodic oxidation of aluminum supports, in particular for printing plates, according to U.S. Pat. No. 3,836,437 is carried out in a 5 to 50% strength aqueous $Na_3PO_4$ solution, at a current density of 0.8 to 3.0 A/dm$^2$, a temperature of 20° to 40° C., and for a duration of 3 to 10 minutes. The aluminum oxide layer thus produced, is stated to possess a weight of 10 to 200 mg/m$^2$.

According to U.S. Pat. No. 3,960,676, the aqueous bath for the electrolytic treatment of aluminum which is thereafter to be provided with a water-soluble or water-dispersible coating substance, contains 5 to 45% of silicates, 1 to 2.5% of permanganates, or borates, phosphates, chromates, molybdates or vanadates, in concentrations ranging from 1% up to saturation.

The anodic oxidation of printing-plate support-materials, composed of aluminum, is also described in British Pat. No. 1,495,861. This oxidation is carried out in a 1 to 20% strength aqueous solution of $H_3PO_4$, or of polyphosphoric acid, employing alternating current at a current density of 1 to 5 $A/dm^2$ at 10° to 40° C.

Another support material for printing plates is known from British Pat. No. 1,587,260. This material carries an oxide layer which is produced by the anodic oxidation of aluminum in an aqueous solution of $H_3PO_3$, or in a mixture of $H_2SO_4$ and $H_3PO_3$, after which a second oxide film, of the "barrier-layer" type, is additionally super-imposed on this relatively porous oxide layer. It is possible for this second oxide layer to be formed by anodic oxidation in aqueous solutions containing, for example, boric acid, tartaric acid, or borates. Both the first stage (Example 3, 5 minutes) and the second stage (Example 3, 2 minutes) are carried out very slowly, the second stage being carried out, moreover, at a comparatively high temperature (80° C.).

Admittedly, an oxide layer produced in these electrolytes is frequently more stable with respect to alkaline media than an oxide layer which has been produced in an electrolyte based on a $H_2SO_4$ solution. It additionally exhibits a number of other advantages, such as a lighter surface, better water-acceptance or low adsorption of dyes ("scumming" in the non-image areas), but is nevertheless possesses significant disadvantages. In a modern belt-type unit for the manufacture of printing-plate supports, it is possible, employing voltages and residence-times which are technically appropriate, to produce oxide-layer weights ranging, for example, up to only approximately 1.5 $g/m^2$, a layer thickness which naturally offers less protection against mechanical abrasion than a thicker layer of the type produced in a $H_2SO_4$ electrolyte. Due to the fact that the pore volume and the pore diameters are larger in an oxide layer which has been built up in $H_3PO_4$, the mechanical stability of the oxide itself is also lower, which results in further losses with regard to abrasion-resistance.

Processes have also been disclosed which attempt to combine the advantages of the two electrolytes, in that electrolyte mixtures composed of $H_2SO_4$ and $H_3PO_4$ are employed, or a two-stage treatment procedure takes place.

The process for manufacturing printing-plate support-materials, composed of aluminum, in accordance with British Pat. No. 1,410,768 is carried out in a manner wherein the aluminum is initially anodically oxidized in an electrolyte containing $H_2SO_4$, and this oxide layer is then subjected to a follow-up treatment in a 5 to 50% strength by volume aqueous $H_3PO_4$ solution, without the action of an electric current. The actual oxide layer is stated to possess a superficial weight of 1 to 6 $g/m^2$; however, this weight decreases significantly on immersion in the aqueous $H_3PO_4$ solution, for example, by approximately 2 to 3 $g/m^2$ per minute of immersion-time in an aqueous $H_3PO_4$ solution. It is stated that an electrochemical treatment in the $H_3PO_4$ solution is also possible (Example 11), or that it should be possible to employ a mixed electrolyte, composed of $H_3PO_4$ and $H_2SO_4$ (Example 12). A removal of the oxide layer is said to also occur in these cases.

Similar processes, in which, however, the treatment with the aqueous $H_3PO_4$ solution is effected exclusively without the influence of an electric current, can also be found in U.S. Pat. No. 3,808,000, or in British Pat. No. 1,441,476. In addition, in German Offenlegungsschrift No. 2,548,177, or in U.S. Pat. No. 3,940,321, there is described a two-stage electrochemical treatment, initially in an electrolyte based on $H_2SO_4$, and then in an electrolyte based on $H_3PO_4$.

U.S. Pat. Nos. 4,049,504 and 4,229,266 describe a mixed electrolyte, composed of $H_2SO_4$ and $H_3PO_4$, for the manufacture of printing-plate support-materials. The latter patent additionally mentions a specific content of aluminum ions.

In European Patent Applications No. 0,007,233 and No. 0,007,234, support materials for aluminum printing plates are anodically oxidized in a process whereby they initially run, as middle conductors, through a bath containing aqueous $H_3PO_4$ and an anode, and then run into a bath containing aqueous $H_2SO_4$ and a cathode. The two electrodes can also be connected to a source of alternating voltage. It is also indicated, but not specified further, that the treatment with $H_3PO_4$ could be a simple immersion treatment, or that it would even be possible to substitute neutral or alkaline solutions for the acids.

Although the processes with mixed electrolytes, with increasing $H_3PO_4$ content, cause the properties of the oxide to be approximated to the properties obtained by an anodic oxidation in pure aqueous $H_3PO_4$ solutions, they nevertheless never reach these properties. On the other hand, the positive properties of an anodic oxidation in pure aqueous $H_2SO_4$ solutions (oxide-layer thickness, abrasion-resistance) also decline. Moreover, a bath-monitoring procedure (in the case of a solution with several components) is very expensive in terms of production technology, and is difficult to control. The two-stage anodic oxidation, or treatment method, leads to a situation wherein the oxide layer which has been built up in the $H_2SO_4$ electrolyte is redissolved in the $H_3PO_4$ solution to an excessive extent under the conditions hitherto known.

The following after-treatment steps for aluminum which has been anodically oxidized in an aqueous $H_2SO_4$ solution are also known in the field of printing-plate support materials:

- the immersion treatment in aqueous solutions of $TiF_4$, $ZrF_4$, $HfF_4$, or of corresponding complex acids or salts (see U.S. Pat. No. 3,440,050),
- the immersion treatment in aqueous solutions of silicates, bichromates, oxalates, or dyes (See U.S. Pat. Nos. 3,181,461 and 3,280,734),
- the immersion treatment in an aqueous solution of polyvinylphosphonic acid (See U.S. Pat. No. 4,153,461),
- the electrolytic treatment in an aqueous solution of sodium silicate (See U.S. Pat. No. 3,902,976),
- the partial detachment, in a first step, of the oxide layer, by means of aqueous acids or bases (e.g., by means of an aqueous solution of $Na_3PO_4$) without the action of an electric current, or under cathodic electrolysis conditions, and the treatment, in a second step, with hot water or steam (See British Pat. No. 1,517,746), it being possible, in addition, for the water to contain dissolved salts in a quantity of up to 20% by weight (phosphates or borates, among others), while its pH should lie within the range from 2 to 11, the treatment temperature being between 70° and 130° C., or a heat treatment, at 100° to 300° C., for approximately 1 minute, in dry air, or using steam (See German Offenlegungsschrift No. 2,716,604).

Of these after-treatment methods, only the silicatizing and the boehmite formation (reaction with $H_2O$ at an elevated temperature) lead to a certain improvement in the resistance of the oxide layers to alkalis. In the case of silicatizing, however, a deterioration can occur in the storage life of presensitized (ready-coated) printing plates, and the treatment to form boehmite can be carried out only with increased difficulty in modern, fast-running belt-type units, since it requires a comparatively long treatment time (exceeding 1 minute, e.g., 5 minutes). Moreover, boehmite formation can lead to a deterioration in the adhesion of the layer.

Occasional publications also describe methods whereby certain surface-modifications are even carried out before the anodic oxidation in $H_2SO_4$ solutions, for example:

European Patent Application No. 0,008,212 describes an electrolysis in a bath containing borate ions, prior to the anodic oxidation in a second bath (e.g. an aqueous $H_2SO_4$ solution), the pH of the first bath to lie within the range from 9 to 11, and the treatment to be carried out at a temperature of 50° to 80° C.; it is desirable that the thickness of the first layer be at least 2 μm, while that of the second layer should lie at higher values (e.g. about 20 μm), British Pat. No. 1,523,030 describes an electrolysis in an aqueous solution of a salt (such as a borate or a phosphate) which contains, if appropriate, an acid or a salt as a barrier-layer forming agent (e.g., boric acid or ammonium borate).

However, both publications refer only to aluminum which is to be employed for window frames, plates (panelling components) and fastening devices for architectural structures, or to decorative aluminum moldings for vehicles or household articles. Moreover, the formation of thinner layers would lead to the possibility of their being redissolved too easily during the second treatment.

In British Pat. No. 1,412,929, an aluminum surface is treated with hot water or steam (with the formation of a layer of boehmite), and an electrolysis is thereafter carried out, as a further treatment, in an aqueous solution of a salt of silicic acid, phosphoric acid, molybdic acid, vanadic acid, permanganic acid, stannic acid, or tungstic acid. This treatment is intended to lead to a greater layer thickness, improved toughness, a finer structure, and hence to greater corrosion-resistance (e.g. against acids or alkali). A similar process is also described in U.S. Pat. No. 3,945,899, where the surface of the aluminum may be in the form not only of a layer of boehmite, but may also be a chemical "conversion layer" resulting from a treatment employing a chromate or a phosphate. In the examples, the durations of the electrolysis treatment lie within the range from 2 to 10 minutes. However, both treatment-steps are too protracted for modern belt-type units and, moreover, the aluminum coatings, produced by non-electrolytic methods, are less suited to the practical requirements which are demanded of high-performance printing plates (e.g., with regard to abrasion-resistance and interactions with the photosensitive coating).

SUMMARY OF THE INVENTION

The object of the present invention is therefore to propose a process for enhancing the resistance to alkali, of support materials for offset-printing plates based on roughened and anodically oxidized aluminum, which process can be carried out, in a modern belt-type unit, comparatively rapidly, and without great expense, in which the proportion of the oxide undergoing redissolution is low, or in which redissolution does not occur, and which preserves the known, positive properties of the oxide layer which derives from the anodic oxidation in an aqueous $H_2SO_4$ solution.

In accomplishing the foregoing objects, there has been provided according to the present invention a process for manufacturing support materials for offset-printing plates, comprising the step of subjecting a support member comprised of aluminum or an alloy thereof, which has been roughened by chemical, mechanical and/or electrochemical treatment to a two-stage anodic oxidation treatment including a first stage (a) comprising anodic oxidation in an aqueous electrolyte comprised of sulfuric acid, and thereafter to a second stage (b) comprising anodic oxidation in an aqueous electrolyte which is different from that in stage (a) and comprises a content of dissolved oxoanions of boron, vanadium, molybdenum, tungsten, and/or carbon, at a voltage between about 10 and 100 V, at a temperature of from about 10° to 60° C., and for a duration of from about 1 to 60 seconds. Preferably, stage (b) is carried out at a voltage between about 20 and 80 V, at a temperature of from about 15° to 50° C., and for a duration of from about 5 to 60 seconds. According to another preferred aspect of the invention, the process further comprises, after stage (b), the step of imparting hydrophilic properties to the support member.

There has been provided according to the present invention an improved support material for offset-printing plates, comprising a support material produced according to the above-described process.

Further objects, features and advantages of the present invention will become apparent from the detailed description of preferred embodiments which follows.

DETAILED DESCRIPTION OF PREFERRED EMBODIMENTS

The invention comprises a process for manufacturing support materials for offset-printing plates, in the form of plates, foils, or strips, from aluminum or from an alloy thereof, which has been roughened by chemical, mechanical and/or electrochemical treatment. This process employs a two-stage anodic oxidation in (a) an aqueous electrolyte based on sulfuric acid, and thereafter in (b) an aqueous electrolyte which is different from that in stage (a). The process according to the invention is therefore one wherein the stage (b) is carried out in an aqueous electrolyte with a content of dissolved oxoanions of boron, vanadium, molybdenum, tungsten and/or carbon, at a voltage between about 10 and 100 V, at a temperature of from about 10° to 60° C., and for a duration of from about 1 to 60 seconds.

The term "oxoanions" is also to be understood as including anions of heteropoly acids, i.e., those containing other atoms, such as phosphorus or silicon, in addition to oxygen.

In a preferred embodiment of the process according to the invention, the stage (b) is carried out at a voltage of between about 20 and 80 V, at a temperature of from about 15° to 50° C., and for a duration of from about 5 to 60 seconds.

The aqueous electrolyte, with the above-mentioned content of oxoanions of boron, vanadium, molybdenum, tungsten, and/or carbon, contains either an acid or, preferably, a salt with the corresponding anion, in particular a salt with an alkali metal cation, an alkaline earth metal cation, or an ammonium cation. The concentration of the aqueous electrolyte can be varied within wide limits, preferably lying between about 5 g/liter and the saturation limit in the particular case. Examples of suitable compounds in the electrolyte are:

sodium carbonate ($Na_2CO_3$)
sodium bicarbonate ($NaHCO_3$)
boric acid ($H_3BO_3$)
sodium tetraborate ($Na_2B_4O_7$)
potassium tetraborate ($K_2B_4O_7$)
sodium perborate ($Na_2B_2O_6$)
potassium metaborate ($KBO_2$)
sodium orthovanadate ($Na_3VO_4$
sodium metavanadate ($NaVO_3$)
sodium molybdate ($Na_2MoO_4$)
sodium tungstate ($Na_2WO_4$)
dodecamolybdophosphoric acid ($H_3PMo_{12}O_{40}$)
sodium dodecamolybdophosphate ($Na_3PMo_{12}O_{40}$)
dodecamolybdosilicic acid ($H_4SiMo_{12}O_{40}$)
dodecatungstophosphoric acid ($H_3PW_{12}O_{40}$)
dodecatungstosilicic acid ($H_4SiW_{12}O_{40}$)
sodium dodecatungstosilicate ($Na_4SiW_{12}O_{40}$)

The resistance to alkali of the layers produced by the process according to the invention generally remains within a comparable order of magnitude, in a manner which is reasonably independent of the electrolyte concentration, i.e., within a range of approximately ±50%, insofar as the time-values recorded in the zincate test are taken as a basis; concentrations of less than approximately 10 g/liter yield zincate-test time-values which tend to fall within the lower range, but are nevertheless markedly better than the untreated oxide layers, while hardly any significant concentration-effect manifests itself at concentrations exceeding approximately 10 g/liter. The variation in the current can be characterized, in an appropriate manner, by a curve according to which, following a very brief initial current density of approximately 3 to 10 A/dm$^2$, the current density falls, after a period of as little as 2 to 5 seconds, to values of less than 1 A/dm$^2$, and then declines almost to zero after only approximately 10 to 20 seconds. With the use of higher voltages, the alkali-resistance of the layers also generally rises. In the case of reaction times of not more than 60 seconds used in the process according to the invention, only a very slight redissolution of the oxide layer (e.g., from approximately 2.8 g/m$^2$ to approximately 2.5 to 2.7 g/m$^2$, i.e., of up to approximately 0.3 g/m$^2$) occurs during the use of acids in the stage (b). If, in contrast, salts are employed in stage (b), in particular neutral salts, virtually no change in the weight of the oxide layer occurs. If elevated temperatures are used in the process according to the invention, the redissolution of the oxide layer can, on occasion, be accelerated, so that, in these cases, the process should rather be carried out in the medium-temperature or low-temperature range, or, instead of an acid, neutral salts should preferably be employed.

Suitable substrates for the manufacture of support materials are composed of aluminum, or of an alloy thereof. These include, for example:

"Pure aluminum" (DIN Material No. 3.0255), i.e., composed of not less than 99.5% of Al, and the following permissible admixtures (maximum total 0.5%) of 0.3% of Si, 0.4% of Fe, 0.03% of Ti, 0.02% of Cu, 0.07% of Zn and 0.03% of other substances, or "Al-alloy 3003" (comparable with DIN Material No. 3.0515), i.e., composed of not less than 98.5% of Al, of the alloying constituents Mg, 0 to 0.3%, and Mn, 0.8 to 1.5%, and of the following permissible admixtures of 0.5% of Si, 0.5% of Fe, 0.2% of Ti, 0.2% of Zn, 0.1% of Cu and 0.15% of other substances.

These aluminum support materials are further roughened, by a mechanical treatment (e.g., by brushing, and/or by treatments employing abrasives), by a chemical treatment (e.g., by means of etchants), or by an electrochemical treatment (e.g., by alternating-current treatments in aqueous HCl solutions, $HNO_3$ solutions, or in salt solutions). In particular, aluminum printing plates which have been subjected to an electrochemical roughening treatment are employed in the process according to the invention.

In the roughening stage, the process parameters generally lie within the following ranges: the temperature of the electrolyte is between about 20° and 60° C., the concentration of active substance (acid-concentration, salt-concentration) is between about 5 and 100 g/liter, the current density is between about 15 and 130 A/dm$^2$, the residence-time is between about 10 and 100 seconds, and the flow-velocity of the electrolyte at the surface of the workpiece to be treated is between about 5 and 100 cm/sec. Alternating current is employed in most cases, but it is also possible to employ modified current-types, such as alternating currents with dissimilar current-intensity amplitudes for the anode and cathode currents. In this process, the mean peak-to-valley roughness, $R_z$, of the roughened surface lies within the range from approximately 1 to 15 μm, in particular within the range from about 3 to 8 μm.

The peak-to-valley roughness is determined according to DIN 4768, in the version dated October 1970. The peak-to-valley roughness, $R_z$, is then the arithmetic mean calculated from the individual peak-to-valley roughness values from five mutually adjacent individual measurement-lengths. The individual peak-to-valley roughness is defined as the distance between two lines, parallel to the median line, which respectively touch the roughness profile at the highest and lowest points within the individual measuring-length. The individual measuring-length is one fifth of the length, projected perpendicularly onto the median line, of that portion of the roughness profile which is directly utilized for the evaluation. The median line is the line which is parallel to the general direction of the roughness profile and which has the shape of the geometrically ideal profile, this line dividing the roughness profile in a manner such that the total of the areas above it which are occupied by material is equal to the total of the areas beneath it which are not occupied by material.

After the roughening process there follows in a further process stage [Stage (a)] a first anodic oxidation treatment of the aluminum. This treatment is carried out in an electrolyte which is based on $H_2SO_4$, in the manner described in the introduction portion of the application acknowledging the state of the art. In addition to $H_2SO_4$, as the major constituent, a suitable electrolyte will also contain $Al^{3+}$ ions, which are either formed during the process or which are already added at the outset, for example, in the form of $Al_2(SO_4)_3$. As described in U.S. Pat. No. 4,211,619, it is possible to adjust the $Al^{3+}$ content to values which even exceed 12 g/liter. Direct current is preferably used for the anodic oxidation in this stage, as well as, moreover, in the stage (b), described earlier in the text. However, it is also possible to employ alternating current, or a combination of these current-types (e.g., direct current with a superposed alternating current). The layer-weights of the aluminum oxide layers produced in stage (a) can vary within the range from approximately 1 to 8 g/m$^2$, corresponding to a layer thickness of approximately 0.3 to 2.5 μm, but they preferably are approximately 1.4 to 3.0 g/m$^2$, corresponding to approximately 0.4 to 1.0 μm. After rinsing with water, this oxide layer is then further treated in stage (b).

These support materials, which have been roughened and subjected to a two-stage anodic oxidation treatment, are used in the manufacture of offset-printing plates possessing a photosensitive coating. It is also possible, in addition, for them to be subjected, for example, to a prior treatment which renders them hydrophilic, as explained in the course of the description of the state of the art.

In principle, all photosensitive coatings are suitable which, after exposure (and optionally with a subsequent developing treatment and/or fixing treatment), provide a surface on which an image is present, and from which printing can be carried out. These coatings are applied to one of the support materials produced according to the present invention, either by the manufacturer of the presensitized printing plates, or directly by the consumer.

In addition to the coatings which contain silver halides, and which are used in many fields, various other coatings are also known, such as are described, for example, in "Light-Sensitive Systems", by Jaromir Kosar, published by John Wiley & Sons, New York, 1965; namely, the colloid-coatings containing chromates and dichromates (Kosar, Chapter 2); the coatings containing unsaturated compounds, in which, upon exposure, these compounds are isomerized, rearranged, cyclized, or crosslinked (Kosar, Chapter 4); the coatings containing compounds which can be photopolymerized, in which, on being exposed, monomers or prepolymers undergo polymerization, optionally with the aid of an initiator (Kosar, Chapter 5); and the coatings containing o-diazoquinones, such as naphthoquinone-diazides, p-diazoquinones, or condensation products of diazonium salts (Kosar, Chapter 7). The coatings which are suitable also include the electrophotographic coatings, i.e., those coatings containing an inorganic or organic photoconductor. In addition to the photosensitive substances, these coatings can, of course, also contain other constituents, such as for example, resins, dyes or plasticizers. In particular, the following photosensitive compositions or compounds can be employed in coating the support materials manufactured by the process according to the invention:

Compounds of o-quinone-diazide, which work positively, preferably o-naphthoquinone-diazide compounds, which are described, for example, in German Pat. Nos. 854,890, 865,109, 879,203, 894,959, 938,233, 1,109,521, 1,144,705, 1,118,606, 1,120,273 and 1,124,817.

Negative-working condensation products from aromatic diazonium salts and compounds with active carbonyl groups, preferably condensation products formed from diphenylaminediazonium salts and formaldehyde, which are described, for example, in German Pat. Nos. 596,731, 1,138,399, 1,138,400, 1,138,401, 1,142,871, and 1,154,123, U.S. Pat. Nos. 2,679,498 and 3,050,502 and British Pat. No. 712,606.

Negative-working mixed condensation products of aromatic diazonium compounds, for example, according to German Offenlegungsschrift, No. 2,024,244, which possess, in each case at least one unit of the general types $A(\text{-}D)_n$ and B, connected by a divalent linking member derived from a carbonyl compound which is capable of participating in a condensation reaction. In this context, these symbols are defined as follows: A is the radical of a compound which contains at least two aromatic carbocyclic and/or heterocyclic nuclei, and which is capable, in an acid medium, of participating in a condensation reaction with an active carbonyl compound, at one or more positions. D is a group of a diazonium salt which is bonded to an aromatic carbon atom of A; n is an integer from 1 to 10, and B is the radical of a compound which contains no diazonium groups and which is capable, in an acid medium of participating in a condensation reaction with an active carbonyl compound, at one or more positions on the molecule.

Positive-working coatings according to German Offenlegungsschrift No. 2,610,842, which contain a compound which, on being irradiated, splits off an acid, a compound which possesses at least one C-O-C group, which can be split off by acid (e.g., an othocarboxylic acid ester group, or a carboxamideacetal group), and, if appropriate, a binder.

Negative-working coatings, composed of photopolymerized monomers, photo-initiators, binders and, if appropriate, further additives. In these coatings, for example, acrylic and methacrylic acid esters, or reaction products of diisocyanates with partial esters of polyhydric alcohols are employed as monomers, as described, for example, in U.S. Pat. Nos. 2,760,863 and 3,060,023, and in German Offenlegungsschriften Nos. 2,064,079 and 2,361,041. Suitable photo-initiators are inter alia benzoin, benzoin ethers, polynuclear quinones, acridine derivatives, phenazine derivatives, quinoxaline derivatives, quinazoline derivatives, or synergistic mixtures of various ketones. A large number of soluble organic polymers can be employed as binders, for example, polyamides, polyesters, alkyd resins, polyvinyl alcohol, polyvinyl-pyrrolidone, polyethylene oxide, gelatin or cellulose ethers.

Negative-working coatings according to German Offenlegungsschrift No. 3,036,077, which contain, as the photosensitive compound, a diazonium salt polycondensation product, or an organic azido compound, and which contain, as the binder, a high-molecular weight polymer with alkenylsulfonylurethane or cycloalkenylsulfonylurethane side groups.

It is also possible to apply photo-semiconducting coatings to the support materials manufactured in accordance with the invention, such as described, for example, in German Pat. Nos. 1,117,391, 1,522,497, 1,572,312, 2,322,046 and 2,322,047, as a result of which highly photo-sensitive electrophotographic printing plates are produced.

The coated offset-printing plates which are obtained from the support materials manufactured by the process according to the invention are converted into the desired printing-form, in a known manner, by imagewise exposure or irradiation, and washing-out of the non-image areas with the aid of a developer, for example, an aqueous-alkaline developing solution. Offset-printing plates having the support materials treated by the process according to the invention are distinguished, in comparison to those plates for which the same support material was treated without applying stage (b), surprisingly, by considerably improved resistance to alkali. In addition, the support materials manufactured in accordance with the invention, or the offset-printing plates or, as the case may be, offset printing forms produced from them, exhibit the following characteristics:

- The layer-weight of the aluminum oxide, which is built up in the electrolyte containing $H_2SO_4$, is either not adversely affected at all, or is affected only to a slight extent, as a result of which the mechanical strength (good resistance to abrasion) is preserved.
- The surface is lighter than in the case when the anodizing in the electrolyte containing $H_2SO_4$ is the sole treatment, this increased lightness leading to improved contrast between image-areas and non-image areas on the printing-form.
- Qualitatively, the resistance to alkali is at least equivalent to that in an oxide layer which has been built up in an electrolyte containing $H_3PO_4$ and, due to the larger layer thickness, is even quantitatively superior.
- The adsorption on the part of the oxide of, for example, dyes from the photosensitive coating is markedly reduced, or even suppressed, as a result of which it is possible to prevent the formation of "scumming" following the developing operation.
- The water-acceptance of the oxide, during printing, is improved in comparison to an oxide which has been produced only in stage (a); the number of copies which can be printed from one plate is comparable to the number which can be printed by conventional printing plates, i.e., by plates which have been anodically oxidized in a single-stage process, in electrolytes containing $H_2SO_4$.

In the preceding description, and in the examples which follow, percentages always denote percentages by weight, unless otherwise stated. Parts by weight are related to parts by volume as the g is related to the $cm^3$. Moreover, in the examples, the following methods were used in order to test the resistance to alkali of the surface, with the results of these tests being collated in every case into Tables:

Zincate test (according to U.S. Pat. No. 3,940,321, columns 3 and 4, lines 29 to 68, and lines 1 to 8):

The rate, in seconds, at which an aluminum oxide layer dissolves in an alkaline zincate solution is a measure of its resistance to alkali. The longer the layer requires to dissolve, the greater is its resistance to alkali. The layer thicknesses should be approximately comparable, since, of course, they also represent a parameter for the rate of dissolution. A drop of a solution, composed of 500 ml of distilled $H_2O$, 480 g of KOH and 80 g of zinc oxide, is placed on the surface to be tested, and the time which elapses before the appearance of metallic zinc is measured, this event being recognizable by a dark coloration of the test spot.

Gravimetric removal

The sample, which is of a defined size and is protected on its rear surface by a lacquer coating, is agitated in a bath which contains an aqueous solution of NaOH, the content of the latter being 6 g/liter. The weight-loss suffered in this bath is determined gravimetrically. Times of 1, 2, 4 or 8 minutes are selected for the duration of the treatment in the alkaline bath.

Comparison Example C1

A bright, as-rolled, 0.3 mm thick aluminum plate was degreased by means of an aqueous-alkaline pickling solution at a temperature of approximately 50° to 70° C. The electrochemical roughening treatment of the aluminum surface was effected by means of alternating current, in an electrolyte containing $HNO_3$, whereby a surface roughness corresponding to an $R_z$-value of approximately 6 $\mu m$ was obtained. The subsequent anodic oxidation was carried out in accordance with the process described in German Offenlegungsschrift No. 2,811,396, in an aqueous electrolyte containing $H_2SO_4$ and $Al_2(SO_4)_3$. This treatment produced a layer-weight of 2.8 $g/m^2$.

EXAMPLE 1

An aluminum strip, prepared in accordance with the data of Comparison Example C1, was subjected to an anodic after-treatment in an aqueous solution containing 20 g/liter of $H_3BO_3$ at a direct voltage of 40 V, at room temperature, for a duration of 30 seconds. In all the examples, a steel electrode was employed as the cathode. The determination of the weight of oxide, which was now lighter in comparison with that of Comparison Example C1, yielded a value of 2.7 $g/m^2$. See Table 1 for further results and process variations.

EXAMPLE 2

An aluminum strip, prepared in accordance with the data of Comparison Example C1, was subjected to an anodic after-treatment in a saturated aqueous solution of $Na_2B_2O_6$, at a direct voltage of of 40 V, at room temperature, for a duration of 30 seconds. The appearance of the surface corresponded to that of Example 1. The determination of the weight of oxide yielded a value of 2.8 $g/m^2$. See Table 1 for further results and process variations.

In order to manufacture an offset-printing plate, this support was coated with the following photosensitive solution, which works negatively:

- 0.70 part by weight of the polycondensation product of 1 mole of 3-methoxy-diphenylamine-4-diazonium sulfate and 1 mole of 4,4'-bis-methoxymethyl-diphenyl ether, precipitated as the mesitylene sulfonate,
- 3.40 parts by weight of 85% strength phosphoric acid,
- 3.00 parts by weight of a modified epoxide resin, obtained by reacting 50 parts by weight of an epoxide resin having a molecular weight of less than 1,000 and 12.8 parts by weight of benzoic acid in ethylene glycol monomethyl ether, in the presence of benzyltrimethylammonium hydroxide,
- 0.44 part by weight of finely-ground Heliogen Blue G (C.I. 74 100),
- 62.00 parts by volume of ethylene glycol monomethyl ether,
- 30.60 parts by volume of tetrahydrofuran, and
- 8.00 parts by volume of butyl acetate.

Following exposure, through a negative mask, the plate was developed with the aid of a solution of

- 2.80 parts by weight of $Na_2SO_4.10H_2O$,
- 2.80 parts by weight of $MgSO_4.7H_2O$,
- 0.90 part by weight of 85% strength phosphoric acid,
- 0.08 part by weight of phosphorous acid, 1.60 parts by weight of a non-ionic wetting agent,
10.00 parts by weight of benzyl alcohol,
20.00 parts by weight of n-propanol, and
60.00 parts by weight of water.

The printing-plate, manufactured in this manner, could be developed rapidly and without scumming. As a result of the light appearance of the surface of the support, a very good contrast resulted between the image-areas and the non-image areas. It was possible to print more than 150,000 copies from one plate.

EXAMPLES 4 TO 16

An aluminum plate which had been pickled, electrochemically roughened and anodically oxidized in accordance with the data of Comparison Example C1, was subjected to an anodic after-treatment, using the aqueous electrolyte solutions listed in Table 1, these treatments being carried out under a direct voltage, at room temperature. The relevant treatment parameters are likewise indicated in Table 1.

TABLE 1

| Example | Electrolyte solution in stage (b) | | Zincate test times (sec) for the process-conditions | | | | | | | | | Reaction time (min) in the case of gravimetric removal* (g/m²) | | | | Weight of oxide layer after stage (b) (g/m²) |
|---|---|---|---|---|---|---|---|---|---|---|---|---|---|---|---|---|
| | | | 20 V | | | 40 V | | | 60 V | | | | | | | |
| | Electrolyte | Concentration (g/l) | 10 | 30 | 60 | 10 | 30 | 60 | 10 | 30 | 60 | 1 | 2 | 4 | 8 | |
| | | | (sec) | | | | | | | | | | | | | |
| C 1 | — | — | without stage (b): 29 | | | | | | | | | 1.6 | 2.5 | 3.3 | 4.7 | 2.80 |
| 1 | $H_3BO_3$ | 20 | 50 | 54 | 56 | 70 | 75 | 76 | 84 | 89 | 91 | 0.7 | 1.0 | 1.6 | 2.7 | 2.70 |
| 4 | $Na_2B_2O_6$ | 20 | 57 | 65 | 76 | 84 | 85 | 92 | 109 | 111 | 118 | — | — | — | — | — |
| 2 | " | saturated | 60 | 68 | 78 | 86 | 99 | 109 | 114 | 117 | 124 | 0.4 | 0.8 | 1.2 | 2.0 | 2.90 |
| 2** | " | " | 59 | 65 | 75 | 87 | 103 | 116 | 123 | 133 | 141 | — | — | — | — | — |
| 5 | $KBO_2$ | 20 | 57 | 65 | 73 | 89 | 100 | 103 | 119 | 131 | 138 | 0.4 | 0.7 | 1.4 | 1.8 | 2.80 |
| 6 | " | 50 | 57 | 65 | 76 | 88 | 94 | 99 | 119 | 136 | 140 | — | — | — | — | — |
| 7 | " | 100 | 59 | 68 | 78 | 90 | 97 | 101 | 120 | 134 | 137 | — | — | — | — | — |
| 8 | $NaVO_3$ | 10 | 52 | 56 | 59 | 78 | 84 | 93 | 98 | 105 | 110 | — | — | — | — | — |
| 9 | " | saturated | 74 | 79 | 79 | 95 | 96 | 109 | 119 | 124 | 128 | 0.6 | 1.0 | 1.9 | 2.4 | 2.80 |
| 10 | $H_3PW_{12}O_{40}$ | 20 | 65 | 63 | 71 | 90 | 97 | 100 | 96 | 104 | 114 | 0.9 | 1.3 | 2.1 | 2.9 | 2.75 |
| 11 | " | 50 | 60 | 64 | 75 | 92 | 96 | 102 | 106 | 117 | 118 | — | — | — | — | — |
| 12 | " | 100 | 61 | 65 | 74 | 90 | 94 | 104 | 102 | 115 | 120 | — | — | — | — | — |
| 13 | $Na_3PW_{12}O_{40}$ | 5 | 64 | 70 | 75 | 94 | 96 | 108 | 101 | 103 | 110 | — | — | — | — | — |
| 14 | " | 20 | 70 | 76 | 80 | 96 | 102 | 110 | 114 | 123 | 126 | — | — | — | — | — |
| 15 | " | 50 | 77 | 81 | 80 | 108 | 118 | 115 | 124 | 134 | 138 | 0.5 | 0.9 | 1.5 | 2.2 | 2.80 |
| 16 | " | 100 | 74 | 78 | 84 | 106 | 115 | 121 | 126 | 138 | 141 | — | — | — | — | — |

**Stage (b) was carried out at 45° C.
*Stage (b) was carried out at 40 V, for 30 seconds.

EXAMPLE 3

An aluminum strip, which had been prepared and subjected to an anodic after-treatment in accordance with the data of Example 2, was coated with the following positive-working photosensitive solution, in order to manufacture an offset-printing plate:

6.00 parts by weight of a cresol/formaldehyde novolak (with softening range of 105° to 120° C., according to DIN 53 181),
1.10 parts by weight of 4-(2-phenyl-prop-2-yl)-phenyl 1,2-naphthoquinone-2-diazide-4-sulfonate,
0.81 part by weight of polyvinyl butyral,
0.75 part by weight of 1,2-naphthoquinone-2-diazide-4-sulfochloride,
0.08 part by weight of crystal violet,
91.36 parts by weight of a solvent mixture composed of 4 parts by volume of ethylene glycol monomethyl ether, 5 parts by volume of tetrahydrofuran, and 1 part by volume of butyl acetate.

The coated strip was dried in a drying tunnel at temperatures of up to 120° C. The printing plate, manufactured in this way, was exposed under a positive original, and developed with the aid of a developer possessing the following composition:

5.30 parts by weight of sodium metasilicate.$9H_2O$
3.40 parts by weight of trisodium phosphate.$12H_2O$
0.30 part by weight of sodium dihydrogen phosphate (anhydrous)
91.00 parts by weight of water.

The printing-form, thus obtained was perfect in terms both of copying technology and printing technology, and, after exposure, possessed a very good contrast. It was possible to print 180,000 copies from one plate.

EXAMPLES 17 TO 39

An aluminum plate which had been prepared in accordance with the data of Comparison Example C1, was subjected to an anodic after-treatment, employing the aqueous electrolyte solutions listed in Table 2, at room temperature, for 30 seconds. The voltages and concentrations which were employed for this purpose can likewise be extracted from this table.

TABLE 2

| Example | Electrolyte solution | | Zincate test times (sec) for the process conditions | | |
|---|---|---|---|---|---|
| | Electrolyte | Concentration (g/l) | 20 V | 40 V | 60 V |
| 17 | $Na_2B_4O_7$ | 20 | 64 | 90 | 118 |
| 18 | " | Saturated | 62 | 88 | 116 |
| 19 | $K_2B_4O_7$ | 20 | 68 | 86 | 109 |
| 20 | $Na_3VO_4$ | 5 | 58 | 73 | 105 |
| 21 | " | 20 | 65 | 85 | 102 |
| 22 | " | 50 | 64 | 87 | 104 |
| 23 | $Na_2MbO_4$ | 20 | 65 | 81 | 96 |
| 24 | $Na_2WO_4$ | 5 | 45 | 76 | 86 |
| 25 | " | 20 | 68 | 75 | 94 |
| 26 | " | 50 | 65 | 79 | 98 |
| 27 | $H_3PMb_{12}O_{40}$ | 5 | 37 | 49 | 64 |
| 28 | " | 20 | 35 | 60 | 81 |
| 29 | $H_3PMb_{12}O_{40}$ | 50 | 37 | 57 | 78 |
| 30 | $Na_3PMb_{12}O_{40}$ | 5 | 39 | 59 | 85 |
| 31 | " | 10 | 56 | 84 | 109 |
| 32 | " | 20 | 63 | 89 | 114 |
| 33 | " | 50 | 62 | 90 | 112 |
| 34 | $H_4SiW_{12}O_{40}$ | 10 | 58 | 73 | 87 |
| 35 | " | 20 | 67 | 77 | 91 |
| 36 | $Na_4SiW_{12}O_{40}$ | 5 | 62 | 81 | 98 |
| 37 | " | 10 | 70 | 96 | 120 |
| 38 | " | 20 | 74 | 99 | 124 |
| 39 | " | 50 | 72 | 100 | 122 |

TABLE 2-continued

| Example | Electrolyte solution: Electrolyte | Electrolyte solution: Concentration (g/l) | Zincate test times (sec) for the process conditions: 20 V | 40 V | 60 V |
|---|---|---|---|---|---|
| 40 | $Na_2CO_3$ | 20 | 52 | 89 | 108 |

EXAMPLE 41

A support which had been subjected to an anodic after-treatment in accordance with Example 31, employing a voltage of 60 V, for a duration of 30 seconds, was coated with the following solution in order to manufacture an offset-printing plate which functions electrophotographically:

10.00 parts by weight of 2,5-bis-(4'-diethylaminophenyl)-1,3,4-oxadiazole 10.00 parts by weight of a styrene/maleic anhydride copolymer, with a softening point of 210° C., 0.02 part by weight of Rhodamine FB (C.I. 45 170)

300.00 parts by weight of ethylene glycol monomethyl ether.

The coating was negatively charged, in the dark, to approximately 400 V, by means of a corona device. The charged plate was exposed, imagewise, in a reproduction camera and was then developed with the aid of an electrophotographic suspension-type developer, composed of a dispersion of 3.0 parts by weight of magnesium sulfate in a solution of 7.5 parts by weight of a resin ester of pentaerythritol in 1,200 parts by volume of an isoparaffin mixture having a boiling range from 185° to 210° C. After removal of the excess developer liquid, the developer was fixed, and the plate was immersed, for 60 seconds, in a solution composed of:

35 parts by weight of sodium metasilicate.$9H_2O$, 140 parts by weight of glycerol, 550 parts by weight of ethylene glycol and 140 parts by weight of ethanol.

The plate was then rinsed off with a powerful jet of water, removing those areas of the photoconductive coating which were not covered with toner, after which the plate was ready to be used for printing.

EXAMPLE 42

An aluminum strip which had been prepared in accordance with the data of Example 2, was, in a further treatment step (additional treatment to impart hydrophilic properties), immersed in a 0.2% strength aqueous solution of polyvinylphosphonic acid, at 50° C., for a duration of 20 seconds. After drying, the support material, which had thus been additionally rendered hydrophilic, was further processed as described in Example 2, it being possible to improve the ink-repelling action in the non-image areas. A still more advantageous treatment to impart hydrophilic properties was obtained by means of the complex-type reaction products described in German Offenlegungsschrift No. 3,126,636, prepared from (a) polymers such as polyvinylphosphonic acid and (b) a salt of a metal cation possessing a valency of at least two.

What is claimed is:

1. A process for manufacturing support materials for offset-printing plates, comprising the step of:

subjecting a support member comprised of aluminum or an alloy thereof, which has been roughened by chemical, mechanical and/or electrochemical treatment, to a two-stage anodic oxidation treatment including a first stage (a) comprising anodic oxidation in an aqueous electrolyte consisting essentially of water sulfuric acid and $Al^{3+}$ ion, so that at least one layer comprising aluminum oxide is deposited on said support member to a layer thickness of about 0.3 to 2.5 microns, and thereafter to a second stage (b) comprising anodic oxidation in an aqueous electrolyte which is different from that in stage (a) and which consists essentially of water and (i) at least one acid comprising an oxoanion of boron, vanadium, molybdenum, or tungsten or (ii) at least one salt having an alkali metal cation, an alkaline earth metal cation or an ammonium cation, and one of said oxoanions at a voltage between about 10 and 100 V, at a temperature of from about 10° to 60° C., and for a duration of from about 1 to 60 seconds.

2. A process as claimed in claim 1, wherein stage (b) is carried out at a voltage between about 20 and 80 V, at a temperature of from about 15° to 50° C., and for a duration of from about 5 to 60 seconds.

3. A process as claimed in claim 1, wherein the aqueous electrolyte in stage (b) contains from about 5 g/liter up to the saturation concentration of an oxo compound of boron, vanadium, molybdenum, or tungsten.

4. A process as claimed in claim 1, further comprising, after stage (b), the step of imparting hydrophilic properties to the support member.

5. A support for offset-printing plates produced according to the process of claim 1.

* * * * *